US012179983B2

(12) United States Patent
Zacherle et al.

(10) Patent No.: US 12,179,983 B2
(45) Date of Patent: Dec. 31, 2024

(54) ARTICLE CARRIER AND BLANK THEREFOR

(71) Applicant: WESTROCK PACKAGING SYSTEMS, LLC, Atlanta, GA (US)

(72) Inventors: Matthew E. Zacherle, Moseley, VA (US); Casey P. Grey, Richmond, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 126 days.

(21) Appl. No.: 17/800,977

(22) PCT Filed: Feb. 22, 2021

(86) PCT No.: PCT/US2021/019055

§ 371 (c)(1),
(2) Date: Aug. 19, 2022

(87) PCT Pub. No.: WO2021/168417

PCT Pub. Date: Aug. 26, 2021

(65) Prior Publication Data

US 2023/0077309 A1 Mar. 9, 2023

Related U.S. Application Data

(60) Provisional application No. 63/145,733, filed on Feb. 4, 2021, provisional application No. 62/979,590, filed on Feb. 21, 2020.

(51) Int. Cl.
*B65D 71/50* (2006.01)
*B65D 71/46* (2006.01)

(52) U.S. Cl.
CPC ..... *B65D 71/50* (2013.01); *B65D 71/46* (2013.01)

(58) Field of Classification Search
CPC ..... B65D 71/40; B65D 71/42; B65D 71/44; B65D 71/46; B65D 71/50
(Continued)

(56) References Cited

U.S. PATENT DOCUMENTS 2,407,529 A 9/1946 Bertram
2,604,354 A 7/1952 Gray
(Continued)

FOREIGN PATENT DOCUMENTS

WO 2002081324 A1 10/2002

OTHER PUBLICATIONS

PCT International Search Report and Written Opinion dated Jun. 10, 2021, issued during the prosecution of PCT International Patent Application No. PCT/US2021/019055.

*Primary Examiner* — Bryon P Gehman
(74) *Attorney, Agent, or Firm* — Brian J. Goldberg; Rohini K. Garg

(57) ABSTRACT

Aspects of the disclosure relate to a top engaging article carrier for packaging one or more articles and a blank for forming the carrier. The article carrier comprises an engaging panel (12A, 12B) having at least one ply and comprising; a first side edge (E1), a first end edge (E2) and a corner (BC) defined by the first side and end edges (E1, E2). The engaging panel (12A, 12B) comprises a corner area (18) extending between the corner (BC) and an article-receiving aperture (A1, A2) in the engaging panel (12A, 12B). The aperture (A1, A2) comprises a first engaging edge (E4) at a position across the corner area (18) from the corner (BC). The first engaging edge (E4) is curved. The first engaging edge (E4) has a radius of curvature (r3) greater than the radius (r1) of the corner aperture (A1, A2).

18 Claims, 9 Drawing Sheets

(58) Field of Classification Search
USPC ..... 206/145, 147–151, 427
See application file for complete search history.

(56) References Cited

U.S. PATENT DOCUMENTS

| | | | | | |
|---|---|---|---|---|---|
| 5,474,172 | A * | 12/1995 | Zavatone | B65D 71/44 | 206/148 |
| 10,836,550 | B2 * | 11/2020 | Zacherle | B65D 71/44 | |
| D918,058 | S * | 5/2021 | L'Heureux | D9/752 | |
| 11,027,905 | B2 * | 6/2021 | Ford | B65D 71/44 | |
| 11,447,317 | B2 * | 9/2022 | Zacherle | B65D 71/42 | |
| 2009/0301928 | A1 | 12/2009 | Beauregard et al. | | |
| 2018/0362234 | A1 * | 12/2018 | L'Heureux | B65D 71/44 | |

* cited by examiner

ARTICLE CARRIER AND BLANK THEREFOR

CROSS-REFERENCE TO RELATED APPLICATIONS

This application claims priority of U.S. Provisional Patent Application No. 62/979,590, filed Feb. 21, 2020 and U.S. Provisional Patent Application No. 63/145,733, filed Feb. 4, 2021, which are hereby incorporated by reference herein in their entirety.

TECHNICAL FIELD

The present disclosure relates to article top engaging devices, article carriers and to blanks for forming the same. More specifically, but not exclusively, the disclosure relates to a carrier of the top-gripping type having one or more apertures for receiving and retaining an article therein.

BACKGROUND

In the field of packaging, it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said panel and define the aperture. The tabs are displaced out of the plane of said panel when an article is received in the aperture, wherein said tabs engage the article generally about a flange or lip of the article.

The present disclosure seeks to provide an improvement in the field of cartons, typically formed from paperboard or the like.

SUMMARY

A first aspect of the disclosure provides an article carrier for packaging one or more articles. The article carrier comprises an engaging panel having; a first side edge, a first end edge, a corner defined by the first side and end edges, and a corner area. The engaging panel comprises an article-receiving aperture. The corner area extends between the corner and the article-receiving aperture. The article-receiving aperture comprises a first engaging edge at a position across the corner area from the corner. The first engaging edge is curved, the first engaging edge has a radius of curvature greater than the radius of the article-receiving aperture.

Optionally, the first engaging edge is positioned such that the first engaging edge intersects with a first notional line extending between the corner and a center of the article-receiving aperture.

Optionally, the first notional line passes through a notional or actual intersection of the first side and end edges.

Optionally, the first engaging edge is defined between a pair of adjacent notches. The pair of adjacent notches may be tangentially contacted by a notional tangential line which passes through respective tangential contacting points on respective outer ends of each of the pair of adjacent notches, the notional tangential line contacts the first engaging edge.

Optionally, the first engaging edge is defined between a pair of adjacent notches. The pair of adjacent notches may be tangentially contacted by a notional tangential line which passes through respective tangential contacting points on respective outer ends of each of the pair of adjacent notches, the notional tangential line intersects with the first engaging edge.

Optionally, the first engaging edge is spaced apart from a center of the article-receiving aperture by a first distance, the first distance is less than the radius of the article-receiving aperture.

Optionally, the first distance is no less than a half of a second distance defined between the corner and the center of the article-receiving aperture.

Optionally, the article-receiving aperture further comprises at least one second engaging edge, the at least one second engaging edge comprises a second engaging edge length dimension, the second engaging edge length dimension is less than a first engaging edge length dimension of the first engaging edge.

A second aspect of the disclosure provides an article carrier for packaging one or more articles. The article carrier comprises first and second layers secured together to form an engaging panel. The engaging panel has; a first side edge, a first end edge, a corner defined by the first side and end edges, and a corner area. The engaging panel comprises an article-receiving aperture. The corner area extends between the corner and the article-receiving aperture. The first layer has a first engaging aperture having a first radius. The second layer has a second engaging aperture having a second radius. The second radius is greater than the first radius. The first and second apertures are concentrically aligned together to provide the article-receiving aperture. The first engaging aperture comprises a first engaging edge at a position across the corner area from the corner.

Optionally, the first engaging edge is positioned such that the first engaging edge intersects with a first notional line extending between the corner and a center of the article-receiving aperture.

Optionally, the first notional line passes through a notional or actual intersection of the first side and end edges.

Optionally, the first engaging edge is curved, the first engaging edge has a radius of curvature greater than the first radius.

Optionally, the first and second layers are secured together at the corner area by at least one glue strip.

A third aspect of the disclosure provides an article carrier for packaging one or more articles. The article carrier comprises an engaging panel. The engaging panel has; a first straight side edge, a first straight end edge, and a corner defined by the side and end edges. The engaging panel comprises an article-receiving aperture defined therein. The article-receiving aperture comprises a first engaging edge at a position across from the corner. The first engaging edge is defined between a pair of adjacent notches. A first notional line extends between the center of the article-receiving aperture and the bottom of one of the pair of adjacent notches. The first notional line intersects with the straight end edge. A second notional line extends between the center of the article-receiving aperture and the bottom of the other of the pair of adjacent notches. The second notional line intersects with the straight side edge.

A fourth aspect of the disclosure provides a blank for forming an article carrier. The blank comprises an engaging panel having; a first side edge, a first end edge, a corner defined by the first side and end edges, and a corner area. The engaging panel comprises an article-receiving aperture. The corner area extends between the corner and the article-receiving aperture. The article-receiving aperture comprises a first engaging edge at a position across the corner area from the corner. The first engaging edge is curved. The first engaging edge has a radius of curvature greater than the radius of the article-receiving aperture.

A fifth aspect of the disclosure provides a blank for forming an article carrier. The blank comprises a first panel and a second panel for forming first and second layers of an engaging panel. The engaging panel has a first side edge and a first end edge. A corner is defined by the first side and end edges and a corner area is provided adjacent thereto. The engaging panel comprises an article-receiving aperture. The corner area extends between the corner and the article-receiving aperture. The first layer has a first engaging aperture having a first radius. The second layer has a second engaging aperture having a second radius. The second radius is greater than the first radius. The first and second apertures are concentrically aligned together to provide the article-receiving aperture. The first engaging aperture comprises a first engaging edge at a position across the corner area from the corner.

A sixth aspect of the disclosure provides a blank for forming an article carrier. The blank comprises an engaging panel having; a first straight side edge, a first straight end edge, and a corner defined by the side and end edges. The engaging panel comprises an article-receiving aperture defined therein. The article-receiving aperture comprises a first engaging edge at a position across from the corner. The first engaging edge is defined between a pair of adjacent notches. A first notional line extends between the center of the article-receiving aperture and the bottom of one of the pair of adjacent notches. The first notional line intersects with the straight end edge. A second notional line extends between the center of the article-receiving aperture and the bottom of the other of the pair of adjacent notches. The second notional line intersects with the straight side edge.

A seventh aspect of the disclosure provides a blank for forming an article carrier. The blank comprises an engaging panel having; a first straight side edge, a first straight end edge, and a corner defined by the side and end edges. The engaging panel comprises an article-receiving aperture defined therein. The article-receiving aperture comprises a first engaging edge at a position across from the corner. The first engaging edge is defined between a pair of adjacent notches. The article-receiving aperture further comprises a plurality of additional engaging edges disposed at respective positions around the circumference of the article-receiving aperture. Each of the plurality of additional engaging edges is defined between adjacent notches. The length of the first engaging edge is greater than the length of each of the additional engaging edges. In other words, the distance between the pair of notches that define the first engaging edge is greater than the distance between the pair of notches that define an additional engaging edge.

An eighth aspect of the disclosure provides an article carrier for packaging at least one article. The article carrier comprises an engaging panel having at least one article retention device located at a corner of the engaging panel. The at least one article retention device comprises an article receiving aperture. The article receiving aperture comprises a first portion providing a first edge defined by a portion of a first circle having a first center and a first radius. The article receiving aperture comprises a second portion providing a second engaging edge defined by a portion of a second circle having a second center and a second radius. The second radius is greater than the first radius.

Optionally, the first and second centers are coincident or in registry with each other.

Optionally, the second engaging edge is coupled to the first edge by a pair of curvilinear cuts.

Optionally, the engaging panel is formed from a single ply of corrugated board.

Optionally, the corrugated board is E flute.

Optionally, the corrugated board is at least one of: A-flute, B-flute, C-flute, D-flute, and F-flute.

Within the scope of this application, it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the disclosure will now be described with reference to the accompanying drawings, in which.

DETAILED DESCRIPTION OF EMBODIMENTS

Detailed descriptions of specific embodiments of packages, blanks and carriers are disclosed herein. It will be understood that the disclosed embodiments are merely examples of the way in which certain aspects of the disclosure can be implemented and do not represent an exhaustive list of all of the ways the disclosure may be embodied. As used herein, the word "exemplary" is used expansively to refer to embodiments that serve as illustrations, specimens, models, or patterns. Indeed, it will be understood that the packages, blanks and carriers described herein may be embodied in various and alternative forms. The Figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
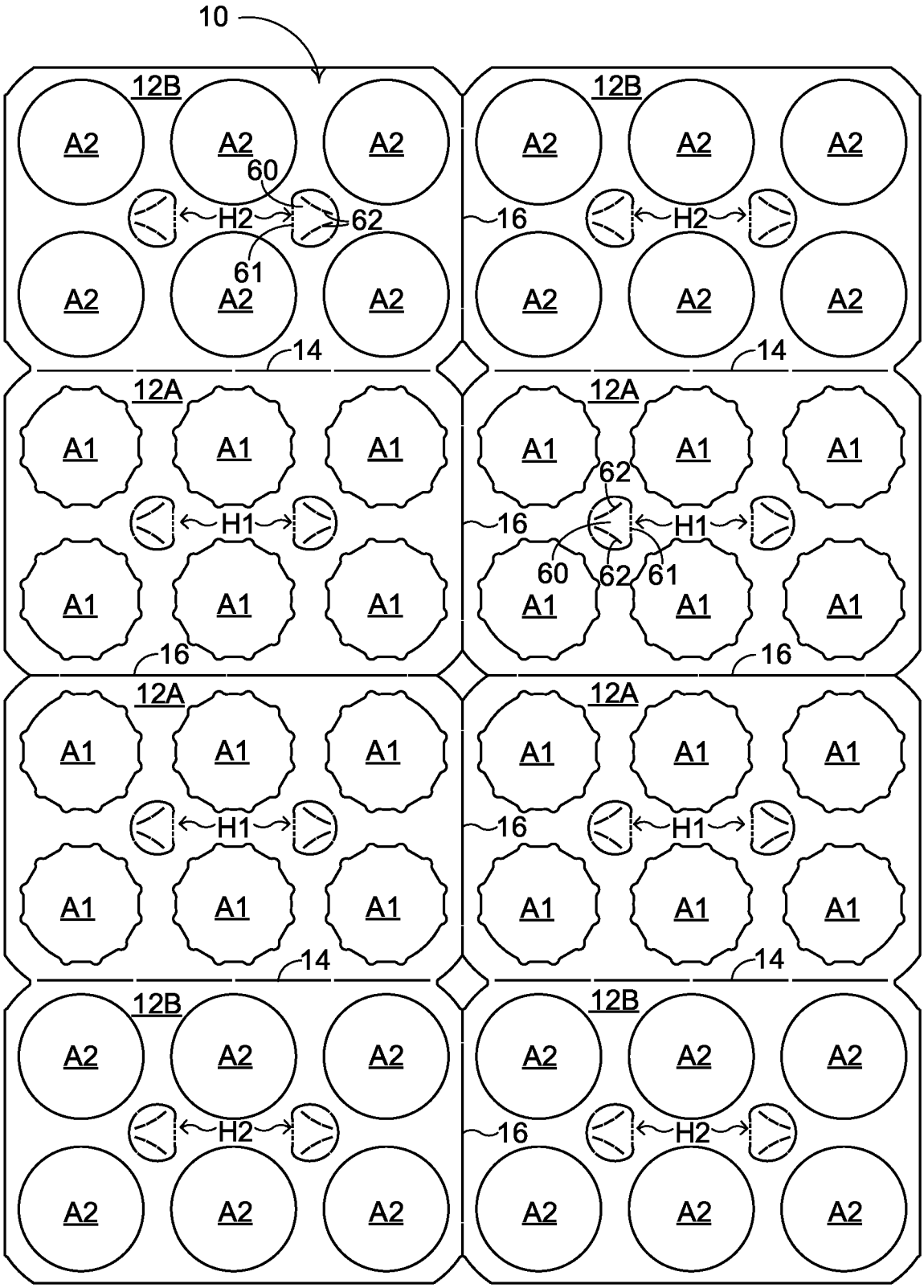
FIG. 1 is a plan view from above of a plurality of connected blanks, each blank capable of forming a carrier according to a first embodiment.
Figure 3:
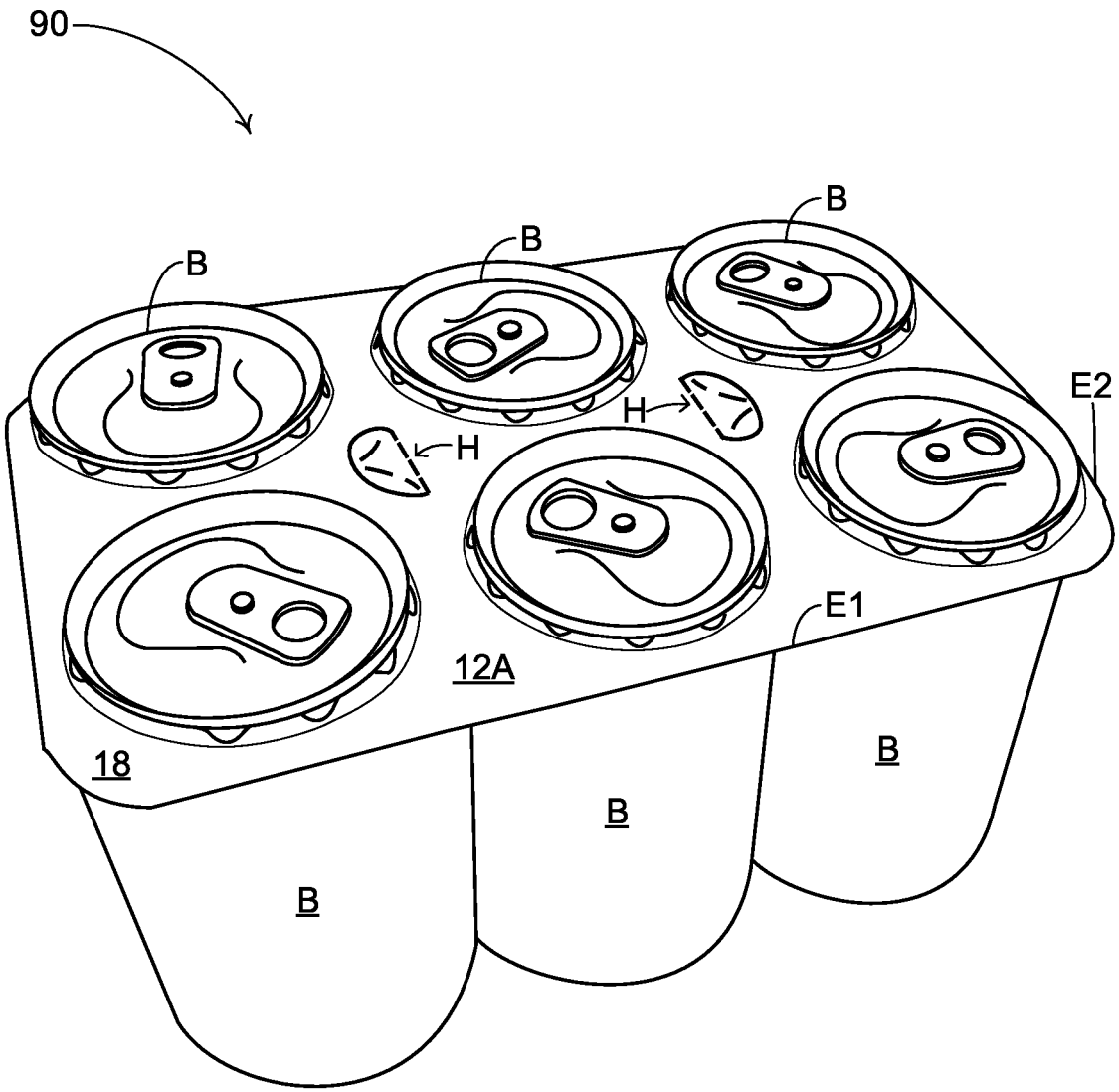
FIG. 3 is a perspective view from above of a carrier formed from one of the blanks of FIG. 2.

Referring to FIG. 1, there is shown a plan view of a plurality of connected blanks 10 each of which is capable of forming a carton or carrier 90, as shown in FIG. 3, for containing and carrying a group of primary products such as, but not limited to, bottles or cans, hereinafter referred to as articles B. The blank 10 forms a secondary package for packaging at least one primary product container or package.

Figure 6:
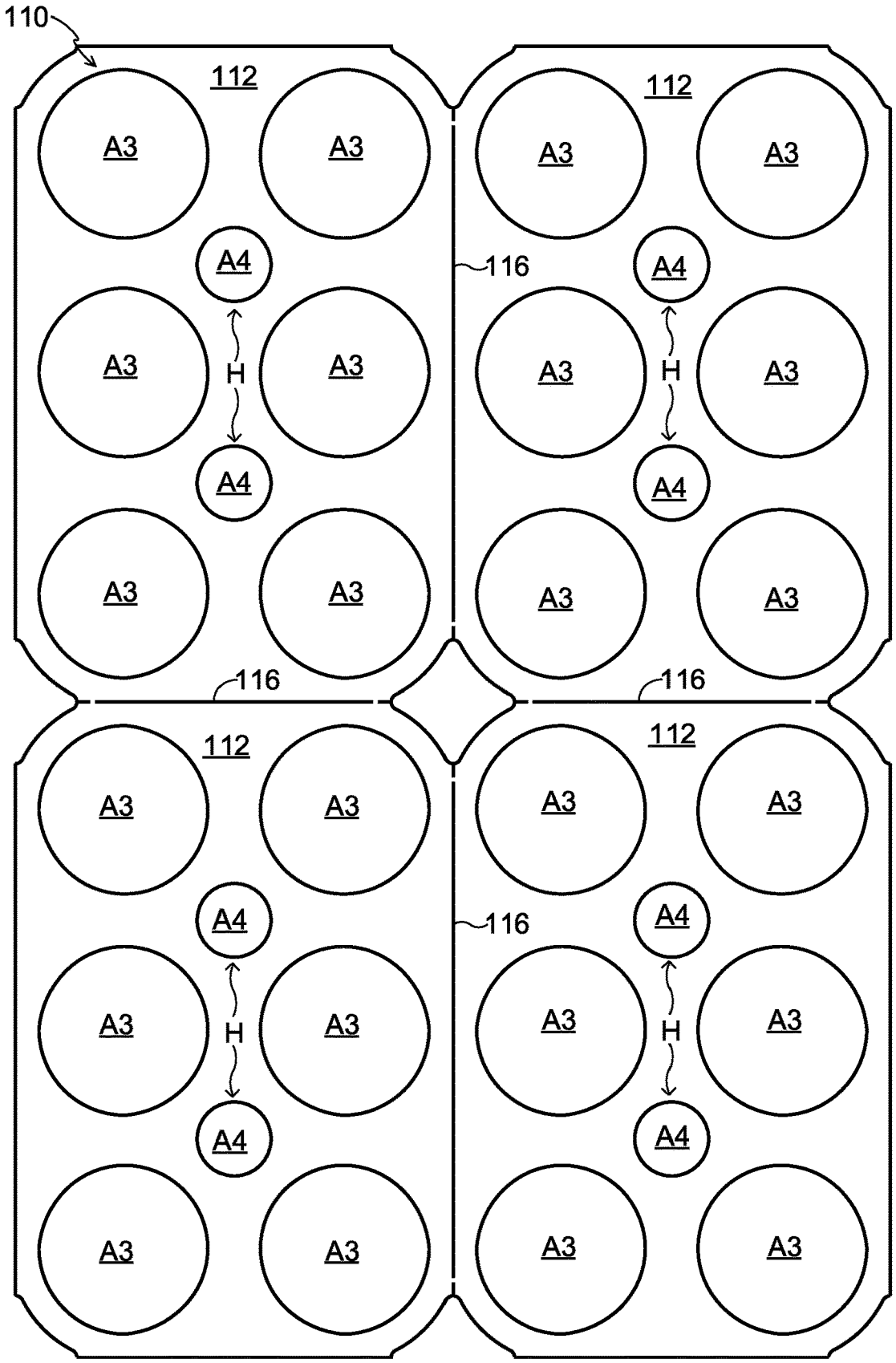
FIG. 6 is a plan view from above of a plurality of connected blanks, each blank capable of forming a carrier according to a second embodiment.
Figure 7:
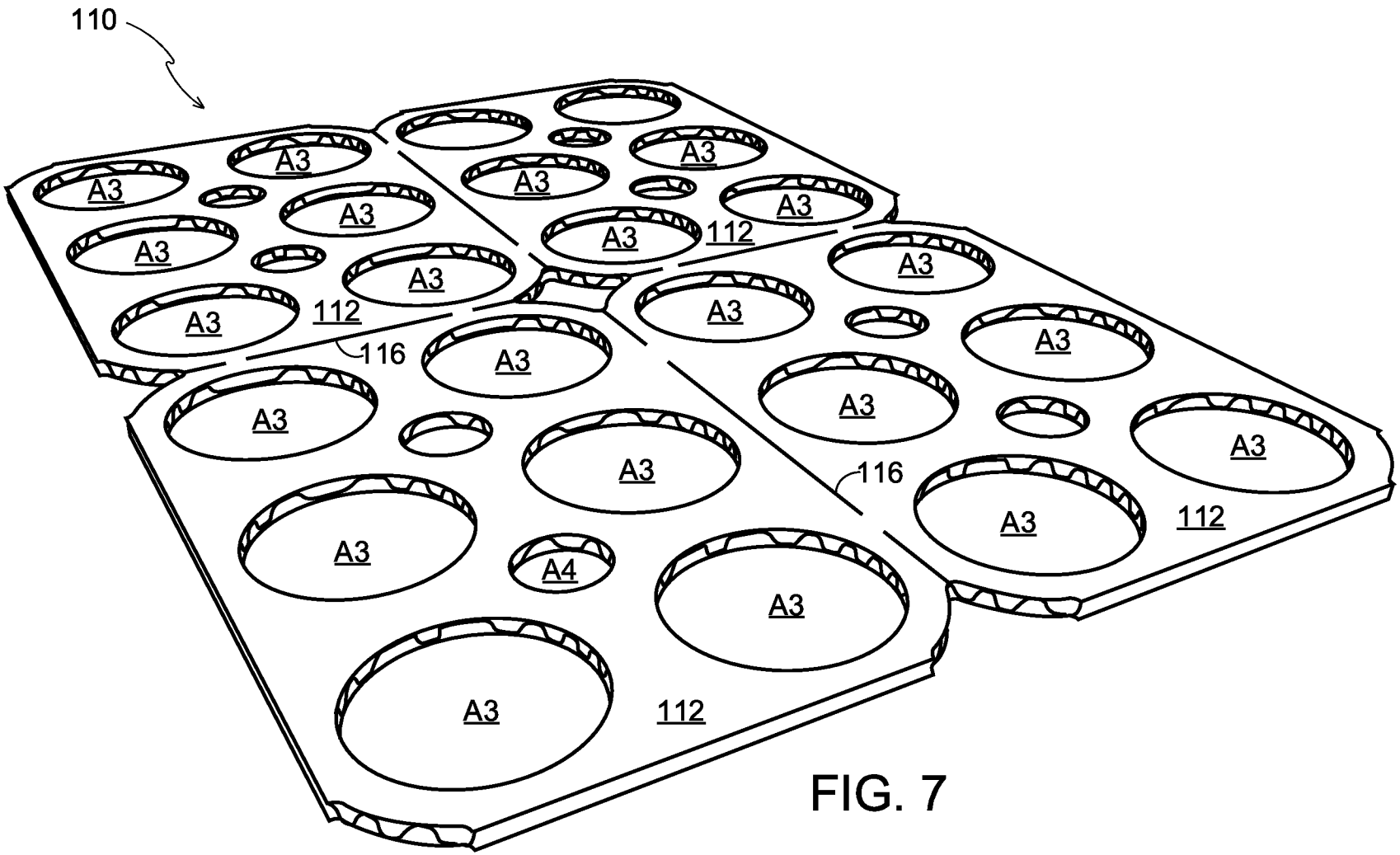
FIG. 7 is a perspective view from above of the plurality of connected blanks of FIG. 6 prior to application to articles.
Figure 9:
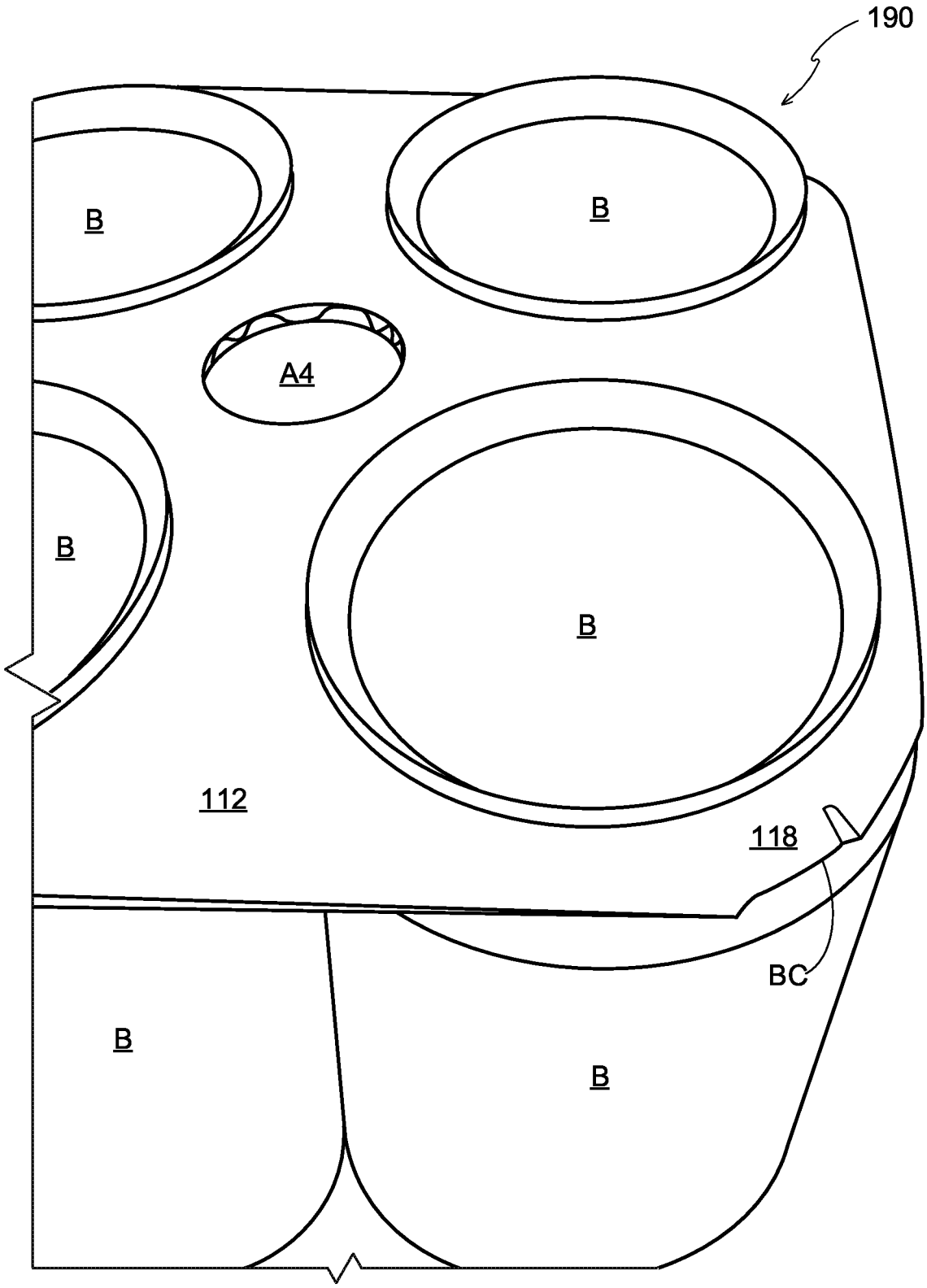
FIG. 9 is a perspective view from above of a portion of a carrier formed from one of the blanks of FIG. 6.

An alternative blank 110 is shown in FIG. 6 for forming carton or carrier 190, as shown in FIG. 9, for containing and carrying a group of primary products such as, but not limited to, bottles or cans, hereinafter referred to as articles B.

In the embodiments detailed herein, the terms "carton" and "carrier" refer, for the non-limiting purpose of illustrating the various features of the disclosure, to a container for engaging and carrying articles, such as primary product containers. It is contemplated that the teachings of the disclosure can be applied to various product containers, which may or may not be tapered and/or cylindrical. Exemplary containers include bottles (for example metallic, glass or plastics bottles), cans (for example aluminum cans), tins, pouches, packets and the like.

The blanks 10; 110 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures, carriers or cartons 90; 190 described herein may be formed from a sheet material such as paperboard or corrugated board. Paperboard or corrugated board useful with the article carrier of the disclosure may be made fully of paper, recyclable fiber and/or biodegradable fiber. Otherwise, paperboard or corrugated board useful with the article carrier of the disclosure may be made of or coated with materials to increase its strength. An example of such a sheet material is tear resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10; 110 are configured to form a carton or carrier 90; 190 for packaging an exemplary arrangement of exemplary articles B. In the embodiments illustrated the arrangement is a 2×3 matrix or array; two rows of three articles are provided, and the articles B are beverage cans. Alternatively, the blanks 10; 110 can be configured to form a carrier for packaging other types, number and size of articles and/or for packaging articles in a different arrangement or configuration.

Referring to FIG. 1 there is shown a plurality of connected blanks 10, specifically there are four blanks 10 arranged in a 2×2 matrix or array. Each blank 10 comprises a pair of main panels 12A, 12B for forming a top wall or engaging panel of a carrier 90 (see FIGS. 3, 5A and 5B). Each blank 10 is connected to at least two adjacent blanks 10 by frangible connections 16.

The pair of main panels 12A, 12B comprises a first main panel 12A for forming an upper layer or ply of the carrier 90 and a second main panel 12B for forming a lower layer or ply of the carrier 90. Each first main panel 12A is hingedly connected to a respective second main panel 12B by a hinged connection in the form of a fold line 14.

In alternative embodiments, carrier 90 may be inverted such that the first main panel 12A forms a lower layer or ply of the carrier 90 and second main panel 12B forms an upper layer or ply of the carrier 90.

Figure 2:
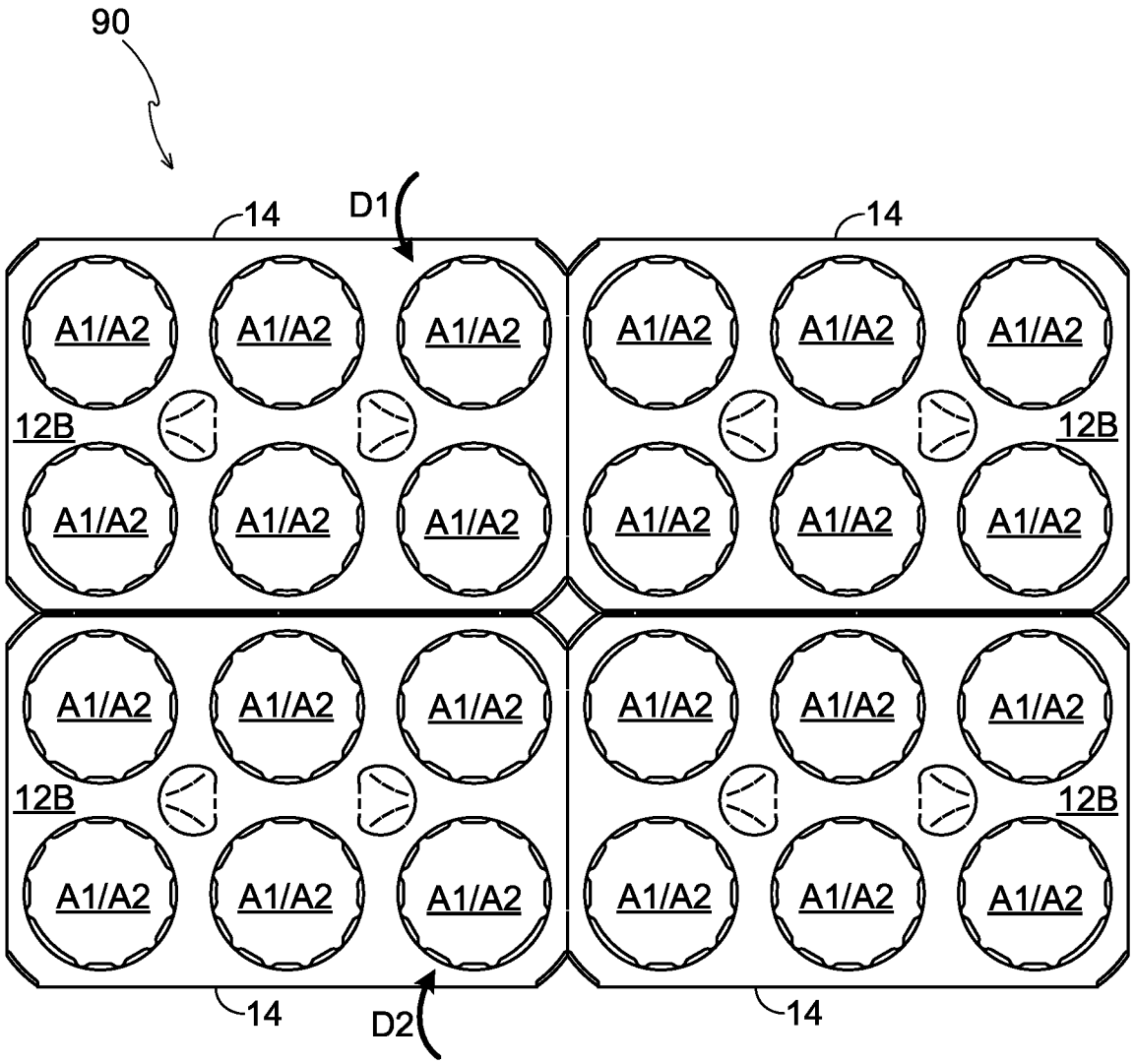
FIG. 2 is a plan view from above of a stage of construction of the blanks of FIG. 1.
Figure 4A:
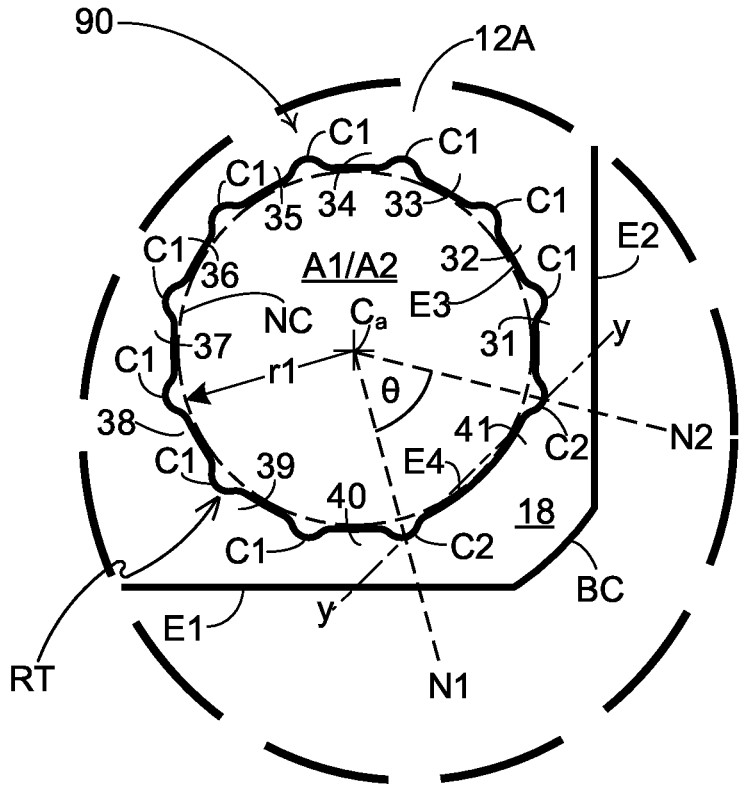
FIGS. 4A and 4B are an enlarged plan views of a portion of one of the blanks of FIG. 1 showing an article retention structure.
Figure 4B:
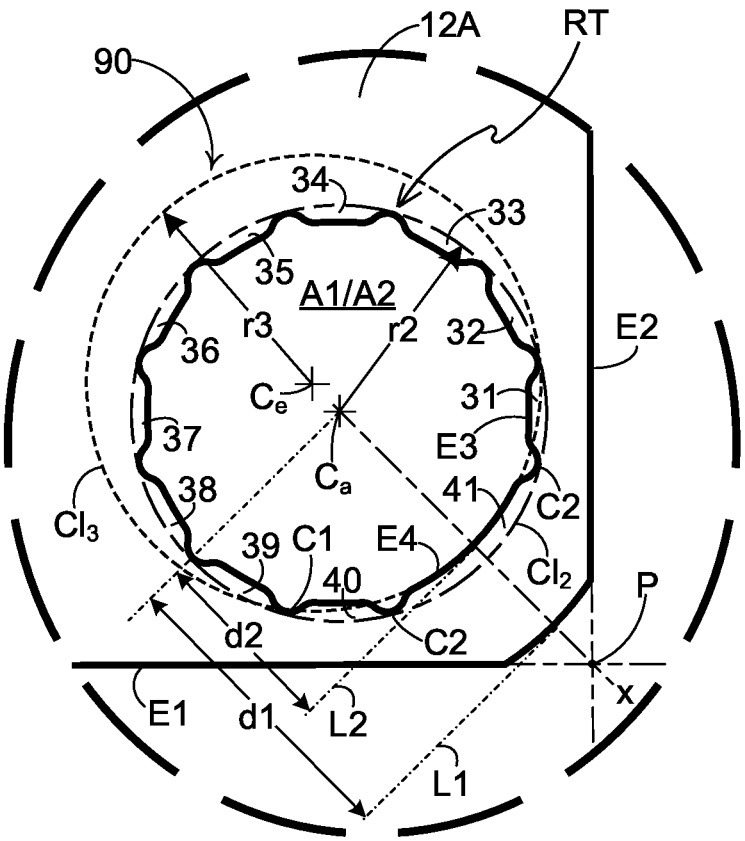

The pair of main panels 12A, 12B includes at least one article retention structure RT, see FIGS. 4A and 4B. In the embodiment of FIGS. 1 and 2 the engaging panel 12A/12B comprises a plurality of article retention structures RT, specifically six article retention structures RT arranged in 2×3 matrix or array. Each of the article retention structures RT comprise an aperture A1, A2.

The article retention structure RT comprises an article receiving opening A1/A2 defined in part by a first aperture A1 defined in, or struck from, the first main panel 12A.

The article receiving opening A1/A2 is defined in part by a second aperture A2 defined in or struck from the second main panel 12B.

The second aperture A2 is substantially circular in shape and has a first diameter. The first aperture A1 comprises, or defines in, the first main panel 12A, an edge E3, E4. The first aperture A1 approximates a notional circle NC having a second diameter. The second diameter may be smaller than the first diameter.

The first aperture A1 comprises one or more cutaways C1, C2 in the form of recesses or notches. The cutaways C1, C2 are substantially "U" shaped, in other embodiments, the cutaways C1, C2 may be alternatively shaped such as but not limited to "V" shaped. The cutaways C1, C2 extend radially outward from the notional circle NC.

The first aperture A1 and second aperture A2 are arranged to be substantially concentric with each other. That is to say the notional circle NC of the first aperture A1 is concentric with the second aperture A2.

The cutaways C1, C2 may be arranged to extend radially outward by a distance substantially half the difference between the diameters of the first and second apertures A1, A2. In this way the outermost edges of the cutaways C1, C2 may define a circle $Cl_2$ having a diameter equal to the diameter of the second aperture A2.

The article retention structure RT may comprise a first minor sector defined in part by a first notional line N1 and in part by a second notional line N2, as shown in FIG. 4A.

The first notional line N1 and the second notional line N2 define a first angle θ therebetween.

The first notional line N1 extends from a center $C_a$ of the notional circle NC, radially outward, through a center of a cutaway C2. The second notional line N2 extends from the center $C_a$ of the notional circle NC, radially outward, through a center of an adjacent cutaway C2.

The first notional line N1 extends or passes through a straight or linear side edge E1 of the carrier 90. The second notional line N2 extends or passes through a straight or linear end edge E2 of the carrier 90. The end edge E2 is disposed adjacent to the side edge E1.

The end edge E2 may be coupled to the side edge E1 by a chamfered, rounded, beveled, or filleted corner BC. In other embodiments, the end edge E2 and the side edge E1 may define a square edge.

The first minor sector of the article retention structure RT defines a first arc.

The first and second notional lines N1, N2 define a second major sector, the second major sector defines a second arc.

The second major sector comprises a plurality of teeth 31, 32, 33, 34, 35, 36, 37, 38, 40 disposed about the second arc, in a perimeter region of the first aperture A1.

The first minor sector of the article retention structure RT comprises a first engaging edge E4 defined between a pair of cutaways C2, C2 in the form of recesses or notches.

Each of the plurality of teeth 31, 32, 33, 34, 35, 36, 37, 38, 40 comprises an engaging or tooth edge E3. Each tooth edge E3 may be linear in shape or may be arcuate. The tooth edges E3 may be defined by an arc or portion of a circle. The tooth edges E3 may be defined by an arc or portion of a circle having a diameter greater than the radius r1 of the notional circle NC.

The first engaging edge E4 is arcuate in shape and may be defined by an arc or portion of a circle. The first engaging edge E4 may be defined by an arc or portion of an engaging edge circle $Cl_3$ having a diameter r3 greater than the radius r1 of the notional circle NC.

The engaging edge circle $Cl_3$ has a center $C_e$. The center $C_e$ is offset from the center $C_a$ of the aperture A1, A2. The center $C_e$ may lie upon the notional line x or a collinear extension thereof. In some embodiments, the center $C_e$ may be coincident, or in registry, with the center $C_a$ of the aperture A1, A2.

Each of the plurality of teeth 31, 32, 33, 34, 35, 36, 37, 38, 40 is defined, at least in part, by a pair of cutaways C1, C2, in the form of recesses or notches. The cutaways C1, C2 form relief elements extending radially away from the center of the notional circle $C_a$.

The two adjacent relief elements C2, C2 of the engaging edge E4 are tangentially contacted by a notional tangential line y-y. The notional tangential line y-y passes through respective tangential contacting points on the two adjacent relief elements C2, C2 at opposing ends of the engaging edge E4. The notional tangential line y-y contacts or intersects with the notional circle NC.

The cutaways C1, C2 define a second notional circle $Cl_2$, the second notional circle $Cl_2$ has a radius r2. The radius r2 is greater than the radius r1 of the notional circle NC. The radius r2 is less than the radius r3 of the engaging edge circle $Cl_3$.

The second notional circle $Cl_2$ may be in registry with the second aperture A2.

The length of the engaging edge E4 may be greater than the length of each tooth edge E3. In other words, the distance between the two adjacent relief elements C2, C2 that define the engaging edge E4 may be greater than the distance between two adjacent relief elements C1, C1 that define the tooth edge E3.

The blank 10 may optionally comprise a handle H1/H2. The first main panel 12A may comprise a first handle structure H1. The second main panel 12B may comprise a second handle structure H2. The first handle structure H1 comprises a first handle opening. The first handle opening defined in, or is struck from, the first main panel 12A and is located in a region disposed centrally between a first pair of first apertures A1 and a second pair of first apertures A1. The first handle opening may be defined at least in part by a cushioning tab 60 hinged to the first main panel 12A by a fold line 61.

The second handle structure H2 comprises a second handle opening. The second handle opening defined in, or is struck from, the second main panel 12B and is located in a region disposed centrally between a first pair of second apertures A2 and a second pair of second apertures A2. The second handle opening may be defined at least in part by a cushioning tab 60 hinged to the second main panel 12B by a fold line 61.

The second handle opening is arranged to be in vertical registry with the first handle opening. The second handle opening may be larger than the first handle opening.

The main panels 12A, 12B include at least a paperboard substrate. The material of the paperboard substrate may be selected from any conventional paperboard, for example, ranging in weight upwardly from about 10 pt. 01"/~0.25 mm), preferably from about 16 pt. (0.016"/~0.41 mm) to about 28 pt. (0.028"/~0.7 mm). An example of such a substrate is a 24 point (pt.) (0.024"/~0.61 mm) SBS board (solid bleached sulphate paperboard coated on one side, trade name PrintKote®) or CNK® board (Coated Natural Kraft®—an unbleached kraft paperboard having a clay coating on one side, trade name CarrierKote™) manufactured by WestRock® Company. The paperboard substrate may be a bleached or unbleached board. The board may be coated on at least one side, optionally the side opposite the lamination, with a conventional coating selected for compatibility with the printing method and board composition.

The main panel 12 may include a tear resistant layer laminated to the paperboard layer. It optionally includes an adhesive layer between the paperboard substrate and the tear resistant layer. The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g., MYLAR®, which is a bi-axially oriented polyester, oriented nylon, cross-laminated polyolefin or high-density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The first and second main panels 12A, 12B are configured to form an engaging panel 12A/12B having two layers or plies of paperboard substrate. A first or upper layer of the engaging panel 12A/12B is provided by the first main panel 12A and second or lower layer of the engaging panel 12A/12B is provided by the second main panel 12B. The second main panel 12B may be bonded or glued to the first main panel 12A.

Figure 5A:
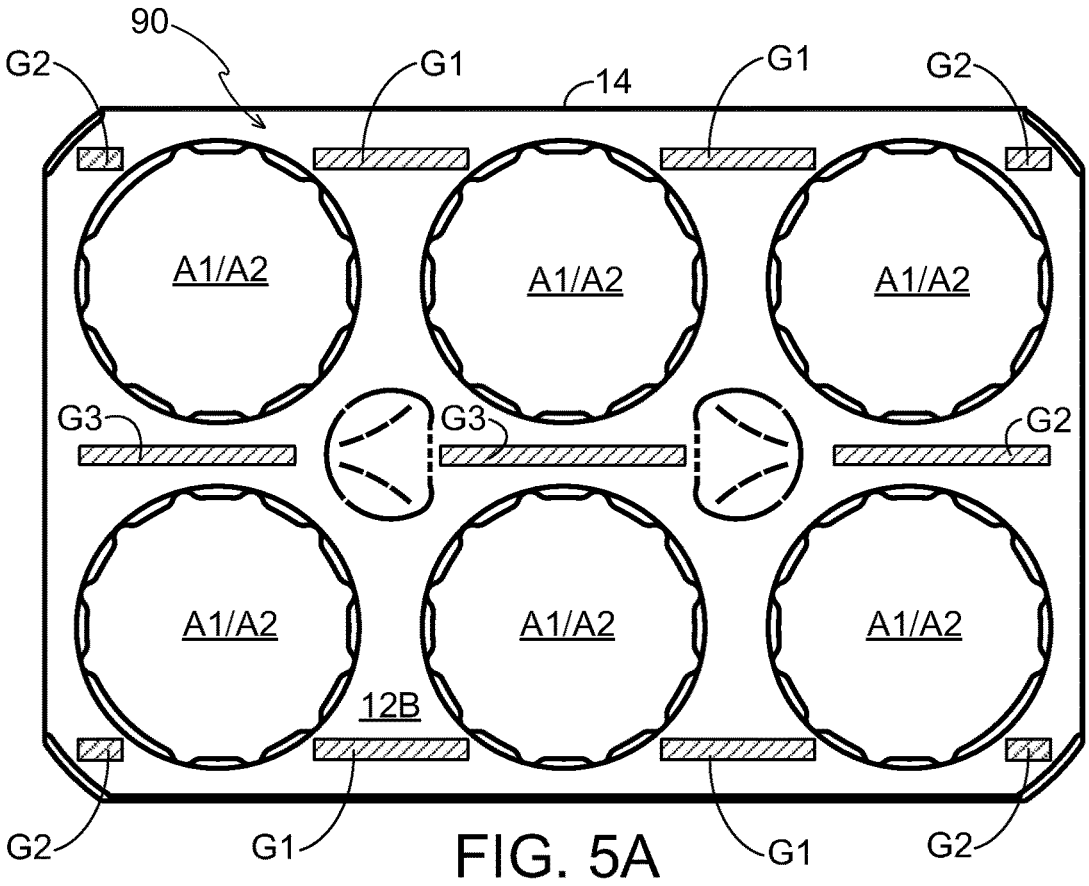
FIG. 5A is a plan view from below of a carrier formed form one of the blanks of FIG. 1.
Figure 5B:
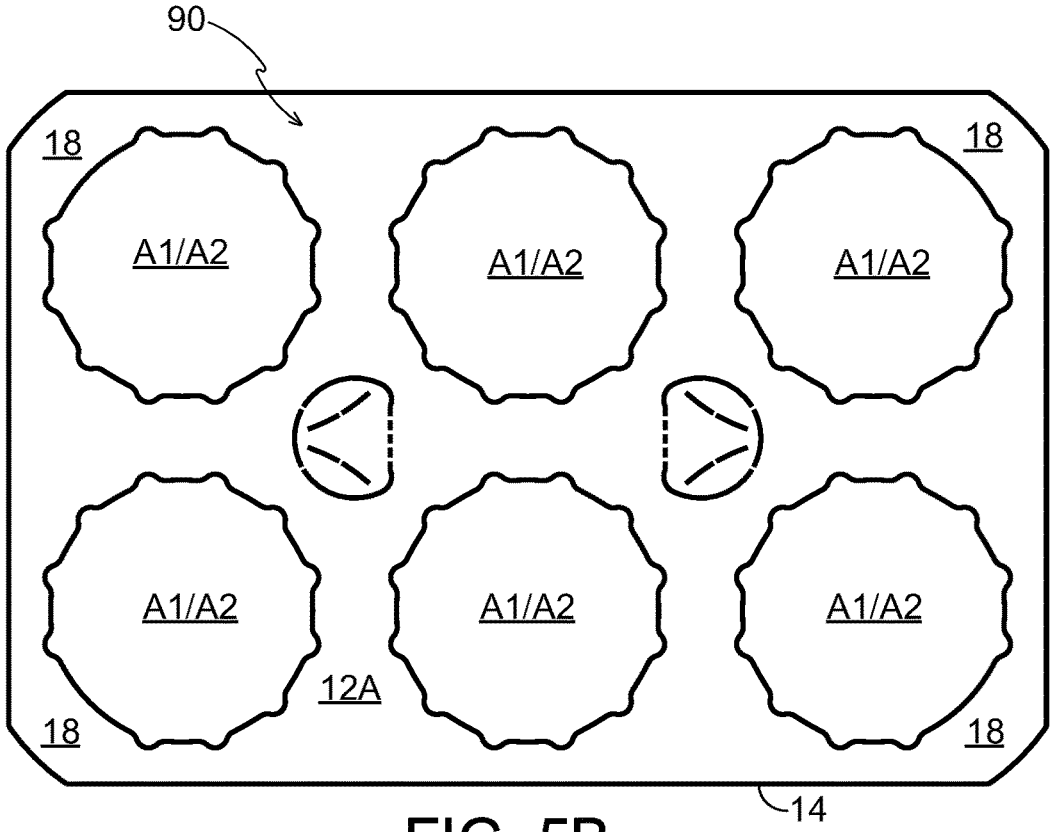
FIG. 5B is a plan view from above of the carrier of FIG. 5B.

Suitable glue locations G1, G2, G3 are shown in FIG. 5A. In other embodiments, different locations may be selected or only some of the glue locations shown in FIG. 5A may be employed.

Corner regions 18 of the first and second main panels 12A, 12B are enlarged sufficiently to provide a glue area G2. This improves adhesion of the first main panel 12A to the second main panel 12B. Other glue locations G1 are provided along marginal side regions of the first and second main panels 12A, 12B. Optional further glue locations G3 may be employed in a medial region of the first and second main panels 12A, 12B.

In some embodiments, a cold seal adhesive or self-seal adhesive layer is coated, formed or provided upon the inside surface of the blank 10. The inside surface of the blank 10 comprises the inside surface of the first main panel 12A and the inside surface of the second main panel 12B. The inside surface of the first main panel 12A is brought into face-to-face contacting relationship with the inside surface of the second main panel 12B to form an engaging panel 12A/12B. Cold seal adhesives seal or bond only to themselves. As such, when the inside surface of the first main panel 12A coated with the cold seal adhesive comes into contact with that of the second main panel 12B coated with the same cold seal adhesive, bond results by simply applying some pressure. (Cold seal adhesive differ from a heat seal adhesive that requires adhesive only on one substrate but must have a source of heat and pressure to make the bond. Cold seal adhesives are different from pressure-sensitive adhesives, which are permanently tacky and must have a release paper covering to prevent adhering to anything until the final use.) The cold seal adhesives useful with the article carrier of the disclosure typically comprise natural rubber latex. Other components may be added to the rubber latex, such as synthetic polymers (e.g., an antioxidant).

The first and second main panels 12A, 12B may be formed from a paperboard substrate having coating on one side. The uncoated side of the first main panel 12A may be bonded to the uncoated side of the second main panel 12B with an adhesive treatment or glue. In one example the first and second main panels 12A, 12B are formed from 24 pt CBS or CNK board, in alternative embodiments different thicknesses or calipers or paperboard may be employed. This produces an engaging panel 12A/12B having a thickness of about 0.048", around 1.22 mm, having coating on opposing faces thereof. An advantage of such a substrate is increased strength without the inclusion of a polymeric material or plastics material, such substrates may provide environmental benefit and be more easily recycled.

The second main panels 12B are folded, about fold lines 14, with respect to the first main panel 12A to which they are hinged, as indicated by direction arrows D1, D2 in FIG. 2. Each second main panel 12B is brought into face-to-face relationship with the first main panel 12A to which it is hinged. Each second main panel 12B may be secured to the first main panel 12A to which it is hinged.

The plurality of blanks 10 of FIG. 1 may thus be formed into a plurality of connected engaging panels 12A/12B each having two plies, as shown in FIG. 2. Each of the plurality of connected engaging panels 12A/12B is frangibly connected to at least two other engaging panels 12A/12B.

In some embodiments, at least one tear resistant layer may be disposed between the first and second layers of the substrate, such a substrate may be formed by bonding two sheets of material at least one of which comprises a tear resistant layer laminated thereto. This may have the advantage of increasing the strength of the substrate.

Turning to the construction of the carrier 90 from the blank 10, the blank 10 may be applied to a group of articles B. The blank 10 is lowered with respect to the group of articles B. Each of the article retention structures RT of the blank 10 are aligned with a respective article B in the group. Portions of the articles B pass through the engaging panel 12A/12B. The teeth 31, 32, 33, 34, 35, 36, 37, 38, 39, 40 of the first main panel 12A about each of the article retention structures RT may be folded out of the plane of the first main panel 12A.

Each tooth 31, 32, 33, 34, 35, 36, 37, 38, 39, 40 of the main panel 12 may be folded about one of the articles B received in the respective one of the article retention structures RT. The blank 10 may deform about the article B for example but not limited to a shoulder portion of the article B, where the article B is a can the shoulder portion may be provide by the neck-in.

The engaging edges E3 of the teeth 31, 32, 33, 34, 35, 36, 37, 38, 39, 40 and the engaging edge E4 of the first main panel 12A engage beneath a projection of the article B. The projection may be located about the neck or chime of the article B (which may provide a flange) of an article B. When the article B is a can the projection may be provided by a canner's end seam. In other embodiments, it may be provided by a ridge or undercut shaping of the article B or by an end closure of the article B for example but not limited to a crown cork or closure. In this way, the engaging edges E3, E4 grip or hold the article B and prevent or inhibit the article B from unintentionally separating from the engaging panel 12A/12B. The assembled carrier 90 is shown in FIG. 3.

Another optional feature of the carrier 90 is that the main panel 12A/12B is defined by a perimeter to which no other part of the carrier 90 is connected. That is to say, the carrier 90 is free of connection to other panels for example, but not limited to, side or end wall panels which extend about the sides of the article group. The perimeter of the main panel 12A/12B is therefore defined in its entirety by free, cut or unhinged edges.

In some embodiments, the plurality of blanks 10 or plurality of connected engaging panels 12A/12B is applied simultaneously to a first group of articles B. The first group of articles B is divisible into a plurality of second groups of articles B. Each second group of articles B is thus formed from a subset of the first group of articles B. In the embodiment illustrated in FIG. 1 the first group of articles B comprises twenty-four articles arranged in a 4×6 matrix or array, and each individual blank 10 accommodates six articles in a 2×3 matrix or array. In this way the plurality of connected engaging panels 12A/12B forms four article carriers 90 or packages.

The frangible connections 14 between the first main panels 12A may separate upon application of the plurality of connected engaging panels 12A/12B to the first group of articles B. Alternatively, the frangible connections 14 may remain intact, individual carriers 90 may be separated from the others at a point of sale or distribution.

Referring now to FIGS. 6 to 9 there is shown an alternative embodiment of the present disclosure. In the second illustrated embodiment, like numerals have, where possible, been used to denote like parts, albeit with the addition of the prefix "100" to indicate that these features belong to the second embodiment. The alternative embodiment shares many common features with the embodiment of FIGS. 1 to 5, therefore only the differences from the embodiment illustrated in FIGS. 1 to 5 will be described in any greater detail.

Referring to FIG. 6, there is shown a plurality of connected blanks 110, specifically there are four blanks 110 arranged in a 2×2 matrix or array. Each blank 110 comprises a main panel 112 for forming a top wall or engaging panel of a carrier 190 (see FIG. 9). Each blank 110 is connected to at least two adjacent blanks 110 by frangible connections 116.

Figure 8:
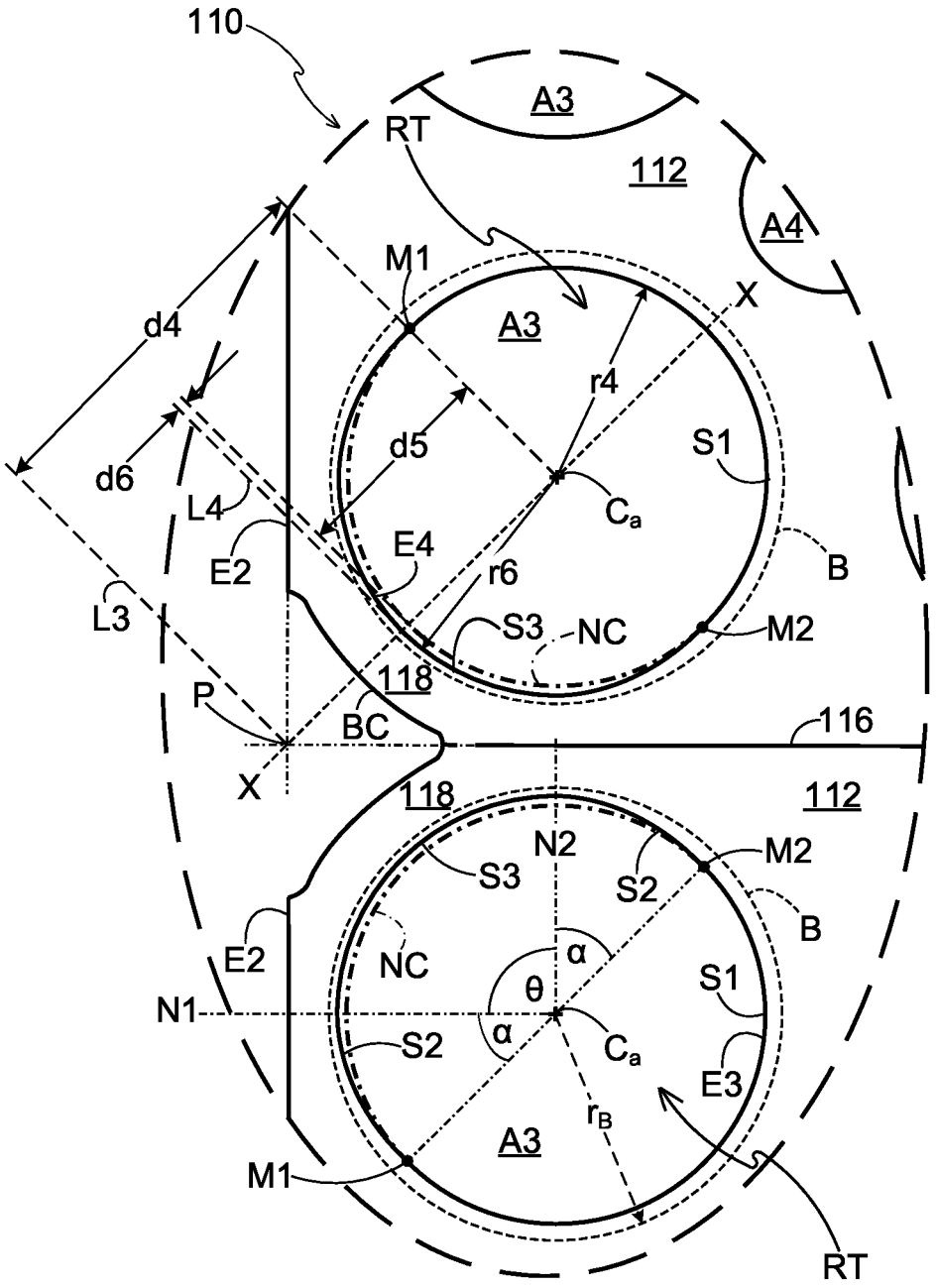
FIG. 8 is an enlarged plan view of a portion of two of the blanks of FIG. 6 showing article retention structures.

Each main panel 112 comprises at least one article retention structure RT, see FIG. 8. In the embodiment of FIGS. 6, the engaging panel 112 comprises a plurality of article retention structures RT, specifically six article retention structures RT arranged in 2×3 matrix or array. Each of the article retention structures RT comprise an aperture A3 forming an article receiving opening.

The aperture A3 comprises a first portion, arc or segment S1, best shown in FIG. 8. The first portion S1 is defined by, or comprises, a substantially circular shape having a center $C_a$ and a first radius r4. The first portion S1 subtends an angle, in the illustrated embodiment, the angle may be 180°, however in other embodiments, the angle may be greater than or less than 180°. Referring to FIG. 8, the first portion S1 extends between a point M1 and a point M2 along the perimeter of the aperture A3. In the illustrated embodiment, a notional line passing through the points M1, M2 defines a transverse axis M1-M2 of the aperture A2.

The aperture A3 comprises a third portion, arc or segment S3. The third portion S3 is curvilinear in shape. The third portion S3 deviates from a first notional circle NC having a center $C_a$ and first radius r4. The third portion S3 may be defined by a part of a third notional circle having a third radius r6, and the third notional circle may have a center coincident, or in registry, with the center $C_a$ of the first portion S1. The first radius r4 is less than the third radius r6. The third portion S3 subtends an angle θ, in the illustrated embodiment, the angle θ is 90°, however in other embodiments, the angle θ may be greater than or less than 90°.

The aperture A3 comprises pairs of second portions, arcs or segments S2. The second portions S2 are curvilinear in shape. Each second portions S2 couples, joins or connects the first portion S1 and the third portion S3.

The second portions S2 provide smooth transition between the first and third portions S1, S3. The second portions S2 each subtend an angle α, in the illustrated embodiment, the angle α is an acute angle and may be in the range 20° to 60°, the angle α may be 45°.

The second portions S2 may be defined by arcs or portions of second notional circles whose centers of curvature are offset from the center of curvature $C_a$ of the first and third portions S1, S3.

The outline of the top rim of an article B relative to the aperture A3 is indicated in FIG. 8 by the phantom/dashed line B. In one embodiment, the article B may be a beverage can, known as a "202 can" whose body diameter is about 2.125 inches (approximately 54 mm). The radius $r_B$ of the rim is 1.063 inches (approximately 27 mm). The radius $r_B$ of rim of the article B is greater than the first radius r4 and greater than the third radius r6.

The radius of curvature r4 of the first portion S1 may be approximated by the formula:

$$r4=0.989/1.063r_B=0.93r_B$$

where "$r_B$" is the radius of curvature of the top rim.

The radius of curvature r6 of the third portion S3 may be approximated by the formula:

$$r6=1.021/1.063r_B=0.96r_B$$

The third portion S3 defines an engaging edge E4 which has been moved closer to a notional corner P of the main panel 112 by a distance d6, the distance d6=r6−r4.

A distance d5 is defined between the notional circle NC and the center $C_a$ of the aperture A3. The total of the distances d5 and d6 is greater than the radius r4 of the first portion S1 of the aperture A3 and equal to the radius r6 of the third portion S3 of the aperture A3.

The radius r6 is no less than a half of the distance d4 between the notional corner P (defined by end edge E2 and severance line 116) of the main panel 112 and the center $C_a$ of the aperture A3.

The severance line 116 defines a side edge of the main panel 112 in a setup carrier 190 and may be coupled to the end edge E2 by a chamfered, rounded, beveled or filleted corner BC. In other embodiments, the side edge and the end edge E2 may define a square corner or vertex. The square corner is indicated by dot-dash lines in FIG. 8 and intersect at the point P. A notional line X-X passing through center $C_a$ and point P, bisects the filleted corner BC. The notional axis X-X defines a longitudinal axis of the aperture A3. The longitudinal axis X-X is perpendicular to the aforesaid transverse axis M1-M2 which also passes through the center $C_a$. The article receiving aperture A3 has a longitudinal dimension along the longitudinal axis X-X and a transverse dimension along the transverse axis M1-M2. The longitudinal dimension of the aperture A3 is equal to the total of the radius r4 and the radius r6 while the transverse dimension of the aperture A3 is equal to twice the radius r4. Therefore, the longitudinal dimension r4+r6 of the aperture A3 is greater than the transverse dimension of the aperture A3.

The engaging edge E4 (or third portion S3) of the aperture A3 is closer to the vertex or point P than the notional circle NC which is coincident, or in registry, with the first portion S1. The engaging edge E4 is radially spaced apart from the notional circle NC by a distance d6.

This has the effect of enlarging the aperture A3 in a corner area 118 of the main panel 112. This may reduce tension and/or stress in the main panel 112 and may prevent or inhibit tear propagation and/or undesirable creasing or deformations. This in turn may improve contact between the engaging panel 112 and the article B.

The third portion S3 defines at least a portion of the engaging edge E4 at a position across from the filleted corner BC. The third portion S3 is defined between a first notional line N1 and a second notional line N2. The first notional line N1 extends from the center Ca of the aperture A3. The first notional line N1 intersects with the end edge E2. The second notional line N2 extends from the center Ca of the aperture A3. The second notional line N2 intersects with the side edge of the main panel 112 defined by severance line 116.

The blank 110 may optionally comprise a handle structure H as best shown in FIG. 6. The handle structure H comprises at least one handle opening A4. A first handle opening A4 is defined in, or is struck from, the main panel 112 and is located in a region disposed centrally between a first pair of first apertures A3 and a second pair of first apertures A3. The first handle opening A4 may be defined at least in part by a cushioning tab 60 hinged to the first main panel 12A by a fold line 61 as best shown in FIG. 1.

The handle structure H comprises a second handle opening A4. The second handle opening A4 is defined in, or is struck from, the main panel 112 and is located in a region disposed centrally between the second pair of apertures A3 and a third pair of apertures A3.

Optionally, the blanks 10; 110 may be formed from a corrugated board material such as but not limited to A-flute, B-flute, C-flute, D-flute, E-flute or F-flute. The corrugated board material may have a low Cobb value, that is to say a low water absorptiveness.

The present disclosure provides a carrier 90; 190 of the top engaging type having improved article retention structures or article top engaging devices RT.

Advantageously, the structural strength at the corner BC of the carrier 90 is improved. An enlarged glue area 18 is provided at the corner BC of the carrier 90 is effective to create a solid or rigid corner two-ply region for contacting the shoulder of an associated article B so as to enhance stability of the can.

The present disclosure provides an article carrier comprising an engaging panel 12A, 12B having at least one ply and comprising; a first side edge E1, a first end edge E2 and a corner BC defined by the first side and end edges E1, E2. The engaging panel 12A, 12B comprises a corner area 18 extending between the corner BC and an article-receiving aperture A1, A2 in the engaging panel 12A, 12B. The aperture A1, A2 comprises a first engaging edge E4 at a position across the corner area 18 from the corner BC. The first engaging edge E4 is curved. The first engaging edge E4 has a radius of curvature r3 greater than the radius r1 of the corner aperture A1, A2.

The first engaging edge E4 may be positioned such that it intersects with a third (or corner) notional line x extending between the corner BC and a center $C_a$ of the aperture A1, A2.

The corner notional line x passes through a notional or actual intersection P of the side and end edges E1, E2, 116.

The first engaging edge E4 is defined between a pair of adjacent notches C2, C2. Each of the pair of adjacent notches C2, C2 is tangentially contacted by a notional tangential line y-y which passes through respective tangential contacting points on respective outer ends of the adjacent notches C2, C2. The notional tangential line y-y contacts or intersects with the first engaging edge E4.

A first distance d2 is defined between the first engaging edge E4 and the center $C_a$ of the aperture A1, A2 is less than the radius r1 of the aperture A1, A2.

The first distance d2 is no less than a half of the distance d1 between the corner BC and the center $C_a$ of the aperture A1, A2.

The aperture A1, A2 further comprises at least one second engaging edge E3, the second engaging edge E3 comprises a length dimension which is less than the length dimension of the first engaging edge E4.

The first engaging edge E4 is positioned and oriented such that the corner notional line x bisects the first engaging edge E4 into two equal sections.

A notional line x which bisects the corner BC and the first engaging edge E4 also passes through the center $C_a$ of the corner aperture A1, A2.

A median point on the first engaging edge E4 is aligned with median point of the corner BC. The corner BC may be generally rounded and defined by a circle which is concentric with a circle defining or approximating the aperture A1, A2. In other embodiments, the center of the circle defining the corner BC may lie upon the corner notional line x or collinear extension thereof.

The present disclosure provides an article carrier comprising first and second layers 12A, 12B secured together to form an engaging panel 12A/12B. The engaging panel 12A/12B has a first side edge E1 and a first end edge E2. A corner BC is defined by the first side and end edges E1, E2. A corner area 18 extends between the corner BC and an article-receiving aperture A1/A2 in the engaging panel 12A/12B. The first layer 12A has a first engaging aperture A1 having a first radius r1. The second layer 12B has a second engaging aperture A2 having a second radius which is greater than the first radius r1. The first and second apertures A1, A2 are concentrically aligned together to provide the engaging aperture A1/A2. The first aperture A1 comprises a first engaging edge E4 at a position across the corner area 18 from the corner BC.

The first engaging edge E4 may be curved, the first engaging edge E4 comprises a radius of curvature r3 greater than the first radius r1.

The first and second layers 12A, 12B may be secured together at the corner area 18 by at least one glue strip G2.

The present disclosure provides an article carrier 90 comprising an engaging panel 12A, 12B having a first straight side edge E1 and a first straight end edge E2 and a corner BC defined by the side and end edges E1, E2. The engaging panel 12A, 12B comprises an article-receiving aperture A1, A2 in the engaging panel 12A, 12B. The aperture A1, A2 comprises a first engaging edge E4 at a position across from the corner BC. The first engaging edge E4 is defined between a pair of adjacent notches C2, C2. A first notional line N1 extends between the center $C_a$ of the aperture A1, A2 and the bottom of one C2 of the pair of adjacent notches C2, C2. The first notional line N1 intersects with the straight side edge E1. A second notional line N2 extends between the center $C_a$ of the aperture A1, A2 and the bottom of the other C2 of the pair of adjacent notches C2, C2. The second notional line N2 intersects with the straight end edge E2.

The carrier 90 may be provided by a blank 19 comprising an engaging aperture A1/A2 having at least one engaging edge E3, E4. The engaging edge E3, E4 is defined between a pair of adjacent relief elements or notches C1, C2. The engaging edge E4 is curved. The bottom or outer edge of each relief element C1, C2, recess or notch is curved. The radius of curvature of each relief element or notch C1, C2 is considerably less than the radius of curvature of the engaging edge E4.

The top engaging article carrier 90 comprises an upper panel 12A and a lower panel 12B disposed in face-to-face contacting relationship with each other. The top engaging article carrier 90 comprises a top engaging device RT comprising a first article receiving opening A2 in the lower panel 12B and a second article receiving opening A1 in the upper panel 12A. The first article receiving opening A2 comprises a first diameter. The second article receiving opening A1 comprises a second diameter. The first diameter is greater than the second diameter. The second article receiving opening may comprise one or more teeth 31, 32, 33, 34, 35, 36, 37, 38, 39, 40, 41 comprising an engaging edge E3, E4 for engaging with an article B.

The top engaging article carrier 90 forms a package with an article B, the article B comprising an upper end having an end diameter, a main body having a body diameter and a neck disposed therebetween and having a neck diameter. The first diameter is equal to or greater than the end diameter. The body diameter may be greater than the first diameter. The neck diameter may be greater than the second diameter.

The top engaging article carrier 90 may accommodate the upper end of article B within the top engaging device RT without folding or deformation of a region of the lower panel 12B. That is to say the upper end of the article B can freely pass through the lower panel 12B or be received in the first article receiving opening A2. The first article receiving opening A2 is greater than or equal to the diameter of the article B measured at the point of engagement with the lower panel 12B.

The present disclosure provides an article carrier 90 comprising an engaging panel 12A, 12B having a first straight side edge E1 and a first straight end edge E2 and a corner BC defined by the side and end edges E1, E2. The engaging panel 12A, 12B comprises an article-receiving aperture A1, A2 in the engaging panel 12A, 12B. The aperture A1, A2 comprises a first engaging edge E4 at a position across from the corner BC. The first engaging edge E4 is defined between a pair of adjacent notches C2, C2. The aperture A1, A2 comprises a plurality of additional engaging edges E3 disposed at respective positions around the circumference of the aperture A1, A2. Each of the plurality of additional engaging edges E3 is defined between adjacent notches C1, C1 or C1, C2. The length of the first engaging edge E4 is greater than the length of each of the additional engaging edges E3. In other words, the distance between the pair of notches C2, C2 that define the first engaging edge E4 is greater than the distance between the pair of notches C1, C1 that define an additional engaging edge E3.

The present disclosure provides an article carrier 90 comprising an engaging panel 12; 112 having at least one article retention device RT located at a corner BC of the main panel 12: 112. The at least one article retention device RT comprises an article receiving aperture A3. The article receiving aperture A3 comprises a first portion S1 providing a first edge E3 defined by a portion of a first circle having a first center $C_a$ and a first radius r1; r4. The article receiving aperture A3 comprises a second portion S3 providing a second engaging edge E4 defined by a portion of a second circle having a second center $C_e$; $C_a$ and a second radius r3; r5, the second radius r3; r5 being greater than the first radius r1; r4. The first and second centers $C_a$, $C_e$ may be coincident or in registry with each other.

The second engaging edge E4 is coupled to the first edge E3 by a pair of curvilinear cuts or edges.

It will be recognized that as used herein, directional references such as "top", "bottom", "base", "front", "back", "end", "side", "inner", "outer", "upper" and "lower" do not necessarily limit the respective panels to such orientation but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, embossed lines, debossed lines, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. An article engaging device comprising an engaging panel having;

a first side edge, a first end edge, a corner defined by the first side and end edges, and a corner area, wherein the engaging panel comprises an article-receiving aperture, and the corner area extends between the corner and the article-receiving aperture, wherein the article-receiving aperture comprises a first engaging edge at a position across the corner area from the corner, and wherein the first engaging edge is configured to engage with an article to be held at least partially within the engaging panel, wherein the first engaging edge is defined between a pair of adjacent notches, and the article-receiving aperture further comprises a plurality of additional engaging edges disposed at respective positions around the circumference of the article-receiving aperture, wherein the plurality of additional engaging edges is defined between adjacent notches, and wherein the first engaging edge has an edge length measured along an entirety of the first engaging edge and each of the additional engaging edges has a tooth edge length, the first engaging edge length being greater than the tooth edge length.

2. An article engaging device according to claim 1 wherein the first engaging edge is curved, the first engaging edge having a radius of curvature greater than the radius of the article-receiving aperture.

3. An article engaging device according to claim 2, wherein the first engaging edge is positioned such that the first engaging edge intersects with a first notional line extending between the corner and a center of the article-receiving aperture, and wherein the first notional line passes through a notional or actual intersection of the first side edge and the first end edge that defines the corner.

4. An article engaging device according to claim 2, wherein the first engaging edge is spaced apart from a center of the article-receiving aperture by a first distance, the first distance is less than the radius of the article-receiving aperture.

5. An article engaging device according to claim 4 wherein the first distance is no less than a half of a second distance defined between the corner and the center of the article-receiving aperture.

6. An article engaging device according to claim 2, wherein the article-receiving aperture further comprises at least one second engaging edge, the at least one second engaging edge comprises a second engaging edge length dimension measured along an entirety of the second engaging edge, the second engaging edge length dimension is less than a first engaging edge length dimension measured along an entirety of the first engaging edge.

7. An article engaging device according to claim 1 wherein the first engaging edge is defined between a pair of adjacent notches, wherein the pair of adjacent notches are tangentially contacted by a notional tangential line which passes through respective tangential contacting points on respective outer ends of each of the pair of adjacent notches, wherein the notional tangential line is either contacting or intersecting with the first engaging edge.

8. An article engaging device according to claim 1, further comprising first and second layers secured together to form the engaging panel, the first layer having a first engaging aperture having a first radius, the second layer having a second engaging aperture having a second radius which is greater than the first radius, the first and second engaging apertures being concentrically aligned together to provide the article-receiving aperture, the first engaging aperture comprising the first engaging edge at a position across the corner area from the corner.

9. An article easier engaging device according to claim 8 wherein the first and second layers are secured together at a glue area of the corner area.

10. An article engaging device according to claim 1, wherein the first side edge is a first straight side edge, wherein the first end edge is a first straight end edge, wherein the first engaging edge is defined between a pair of adjacent notches, wherein a first notional line extends between a center point of the article-receiving aperture and a bottom point of one of the pair of adjacent notches, the first notional line intersecting with the first straight end edge, and wherein a second notional line extends between a center of the article-receiving aperture and a bottom point of the other of the pair of adjacent notches, the second notional line intersecting with the first straight side edge.

11. A blank for forming an article carrier, the blank comprising an engaging panel having;

a first side edge, a first end edge, a corner defined by the first side and end edges, and a corner area, wherein the engaging panel comprises an article-receiving aperture, the corner area extends between the corner and the article-receiving aperture, and wherein the article-receiving aperture comprises a first engaging edge at a position across the corner area from the corner, and wherein the first engaging edge is configured to engage with an article to be held at least partially within the engaging panel, wherein the first engaging edge is defined between a pair of adjacent notches, and the article-receiving aperture further comprises a plurality of additional engaging edges disposed at respective positions around the circumference of the article-receiving aperture, wherein the plurality of additional engaging edges is defined between adjacent notches, and wherein the first engaging edge has an edge length measured along an entirety of the first engaging edge and each of the additional engaging edges has a tooth edge length, the first engaging edge length being greater than the tooth edge length.

12. A blank for forming an article carrier according to claim 11, the blank comprising a first panel and a second panel for forming first and second layers of the engaging panel, the first layer having a first engaging aperture having a first radius, the second layer having a second engaging aperture having a second radius which is greater than the first radius, the first and second engaging apertures being concentrically aligned together to provide the article-receiving aperture, the first engaging aperture comprising the first engaging edge at a position across the corner area from the corner.

13. A blank according to claim 11 wherein the first side edge is a first straight side edge, wherein the first end edge is a first straight end edge, wherein the first engaging edge is defined between a pair of adjacent notches, wherein a first notional line extends between the center of the article-receiving aperture and the bottom of one of the pair of adjacent notches, the first notional line intersecting with the first straight end edge, and wherein a second notional line extends between the center of the article-receiving aperture and the bottom of the other of the pair of adjacent notches, the second notional line intersecting with the first straight side edge.

14. A blank according to claim 11 wherein the first engaging edge is curved, the first engaging edge having a radius of curvature greater than the radius of the article-receiving aperture.

15. An article easier-engaging device for packaging at least one article, the article carrier comprising:

an engaging panel having at least one article retention device located at a corner portion of the engaging panel, the at least one article retention device comprising an article-receiving aperture, the article-receiving aperture comprising a first portion providing a first engaging edge defined by a portion of a first circle having a first center and a first radius, wherein the article receiving aperture comprises a second portion providing a second engaging edge defined by a portion of a second circle having a second center and a second radius, the second radius being greater than the first radius wherein one end of the second engaging edge is connected to an adjacent end of the first engaging edge by a curvilinear segment.

16. An article engaging device according to claim 15 wherein the first and second centers are coincident.

17. An article engaging device according to claim 15 wherein the first and second centers are offset from each other.

18. An article engaging device according to claim 15, wherein the article receiving aperture has a center point and defines a transverse axis passing through the center point and extending between respective end points of the first portion providing the first edge, the article receiving aperture further defining a longitudinal axis passing through the center point and disposed perpendicular to the transverse axis, wherein the article receiving aperture has a longitudinal dimension measured along the longitudinal axis and a transverse dimension measured along the transverse axis, and wherein the longitudinal dimension is greater than the transverse dimension.

* * * * *